US006286260B1

(12) United States Patent
Grabowski

(10) Patent No.: US 6,286,260 B1
(45) Date of Patent: Sep. 11, 2001

(54) SLIDING REAR HALF DOOR FOR CLUB-CAB PICK UP

(75) Inventor: Norbert E. Grabowski, Rochester Hills, MI (US)

(73) Assignee: Chrysler Corporation, Auburn Hills, MI (US)

( * ) Notice: Subject to any disclaimer, the term of this patent is extended or adjusted under 35 U.S.C. 154(b) by 0 days.

(21) Appl. No.: 09/048,761

(22) Filed: Mar. 26, 1998

(51) Int. Cl.[7] ..... E05D 15/10

(52) U.S. Cl. ..... 49/216; 49/213; 49/218; 49/223

(58) Field of Search ..... 49/209, 213, 214, 49/216, 218, 223, 225, 410, 360, 280, 215, 208; 296/155

(56) References Cited

U.S. PATENT DOCUMENTS

| | | | | |
|---|---|---|---|---|
| 1,712,562 | * | 5/1929 | Jeffers | 49/214 |
| 3,484,993 | * | 12/1969 | Erb et al. | 49/216 |
| 3,935,674 | * | 2/1976 | Williams et al. | 49/212 |
| 4,152,872 | | 5/1979 | Tanizaki et al. . | |
| 4,464,863 | * | 8/1984 | Chikaraishi et al. | 49/213 |
| 4,544,198 | * | 10/1985 | Ochiai et al. | 296/155 |
| 4,573,286 | * | 3/1986 | Favrel et al. | 49/214 |
| 4,615,558 | | 10/1986 | Nakamura et al. . | |
| 4,662,109 | * | 5/1987 | Yui et al. | 49/214 |
| 4,692,960 | | 9/1987 | Jozefczak . | |
| 4,753,039 | * | 6/1988 | Jeuffray et al. | 49/214 |
| 4,848,832 | | 7/1989 | Starnes . | |
| 4,862,640 | * | 9/1989 | Boyko et al. | 49/213 |
| 4,869,544 | * | 9/1989 | Anwyll et al. | 296/155 |
| 4,887,390 | * | 12/1989 | Boyko et al. | 49/214 |
| 4,976,488 | * | 12/1990 | Asai et al. | 296/155 |
| 4,991,905 | * | 2/1991 | Watanabe et al. | 296/155 |
| 5,398,988 | | 3/1995 | DeRees et al. . | |
| 5,491,875 | | 2/1996 | Siladke et al. . | |
| 5,536,061 | * | 7/1996 | Moore et al. | 296/155 |
| 5,749,611 | * | 5/1998 | Watson et al. | 292/336.3 |
| 5,906,071 | * | 5/1999 | Buchanan | 49/360 |

FOREIGN PATENT DOCUMENTS

| | | | | |
|---|---|---|---|---|
| 1016890 | * | 6/1991 | (GB) | 49/215 |
| 3140584 | * | 6/1991 | (JP) | 49/360 |

OTHER PUBLICATIONS

Machine Design, News Trends, pp. 19–22, Feb. 1993.*
*1993 Chevrolet–Geo Auto Show Materials*, "World Unveiling of Highlander at Detroit Show" (Dec. 10, 1992).
"_Doors to the Future", *Detroit News*.

* cited by examiner

*Primary Examiner*—Gregory J. Strimbu
(74) *Attorney, Agent, or Firm*—Mark P. Calcaterra

(57) ABSTRACT

A pickup truck having an extended cab passenger compartment and a pair of front doors disposed on opposite sides of the passenger compartment. A sliding rear door is disposed rearward of one of the pair of front doors. The sliding rear door is supported for sliding movement between a closed position and an open position by an upper track and a pair of lower tracks which are each engaged by a corresponding guide arm which is mounted to the sliding rear door. The upper and lower tracks are mounted so as to be concealed from view when the sliding rear door is in the closed position.

7 Claims, 5 Drawing Sheets

10
24
38
40
22
18

10
40
24
38
22
36
14
18

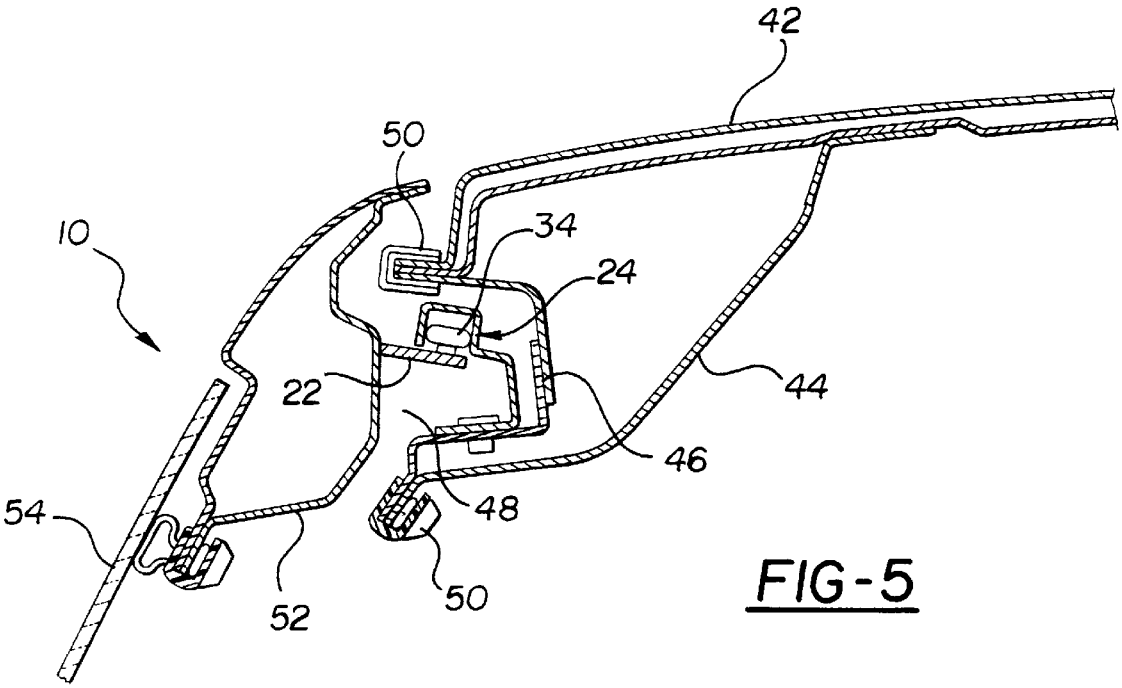
FIG-5
FIG-6
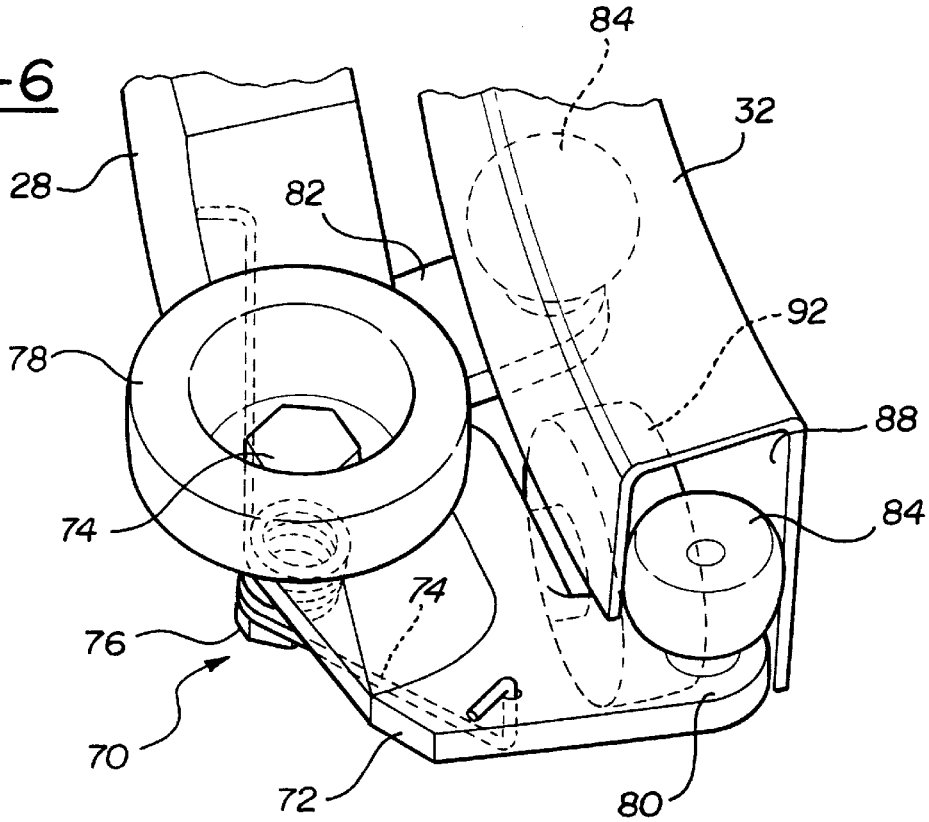

SLIDING REAR HALF DOOR FOR CLUB-CAB PICK UP

BACKGROUND OF THE INVENTION

Field of the Invention

The present invention relates to club-cab pick up trucks, and more particularly, to a sliding door for access to the rear portion of the club-cab.

BACKGROUND AND SUMMARY OF THE INVENTION

It is well known in the automotive industry to have a pick up truck with an extended cab, or what is sometimes called a club-cab. Club-cab pick up trucks provide additional space behind the front seats for additional seating and/or storage. Club-cab pick up trucks provide an alternative design to conventional pick up trucks which have limited inside cargo carrying capability as well as limited passenger carrying capability. With its increased passenger carrying and cargo carrying capability, club-cab pick ups have become extremely popular in recent years. Along with the increased popularity of club-cab pick up trucks has come an increased demand for improved accessibility to the rear portion of the passenger compartment of the club-cab pick up.

Accordingly, previous designs have provided extended cab pick up trucks with an additional cargo door pivotally mounted to the door frame by a hinge. However, these types of hinges typically do not allow the rear cargo door to swing fully clear of the door opening, and therefore, partially obstruct the access to the rear cargo/passenger portion of the passenger compartment. Furthermore, some hinge designs include the hinges being exposed on the exterior of the vehicle. However, the exposed hinges greatly detract from the appearance of the vehicle.

One alternative to providing a hinged rear door is providing a sliding rear door as typically utilized in van vehicles. Typically, the sliding door utilized in a van vehicle requires a longitudinal slot for receiving a middle guide arm on the door to extend along the side of the vehicle. Additionally, pick-up trucks are almost always provided with a small gap between the bed of the pick-up truck and the cab for structural reasons. Thus, the well known sliding door designs as typically utilized in van vehicles does not lend itself to use with a club-cab pick-up truck. However, the sliding door concept provides a good alternative to the hinge door designs, since the sliding door concept would allow the rear door to be moved fully clear of the door opening to allow maximum access to the rear passenger/cargo area of the club-cab passenger compartment.

Accordingly, the present invention provides a rear sliding door assembly for a motor vehicle having a cab with front doors and at least one rear sliding door, the sliding door assembly comprising a rear sliding door and a track structure for supporting the sliding door for sliding movement between a closed position and an open position, the track structure being mounted so that it is concealed from view when the sliding door is in the closed position. Specifically, an upper track and a pair of lower tracks are provided along with an upper guide arm which engages the upper track and a pair of lower guide arms which engage the pair of lower tracks for supporting the rear sliding door. The upper track is at least partially concealed by a vehicle ceiling trim member, while the lower tracks are disposed beneath the floor panel and door sill. The upper guide arm includes a roller disposed on an end thereof for engagement with the upper track. A pivot bracket is disposed on an end of the lower guide arms. The pivot bracket supports a first support roller for generally vertically supporting the lower guide arms along a roller support surface. The pivot bracket further supports a pair of guide rollers for engagement with a respective one of the pair of lower tracks. The pair of lower tracks include a front lower track and a rear lower track. A rear edge of the rear lower track is disposed forward of the rear edge of the door opening.

Further areas of applicability of the present invention will become apparent from the detailed description provided hereinafter. It should be understood however that the detailed description and specific examples, while indicating preferred embodiments of the invention, are intended for purposes of illustration only, since various changes and modifications within the spirit and scope of the invention will become apparent to those skilled in the art from this detailed description.

BRIEF DESCRIPTION OF THE DRAWINGS

The present invention will become more fully understood from the detailed description and the accompanying drawings, wherein:

FIG. 5 is a cross-sectional view of the upper guide track and upper guide arm with the rear sliding door in a closed position;

FIG. 6 is a perspective view of the guide and support roller assembly for the lower support arms;

DETAILED DESCRIPTION OF THE PREFERRED EMBODIMENTS

Figure 1:
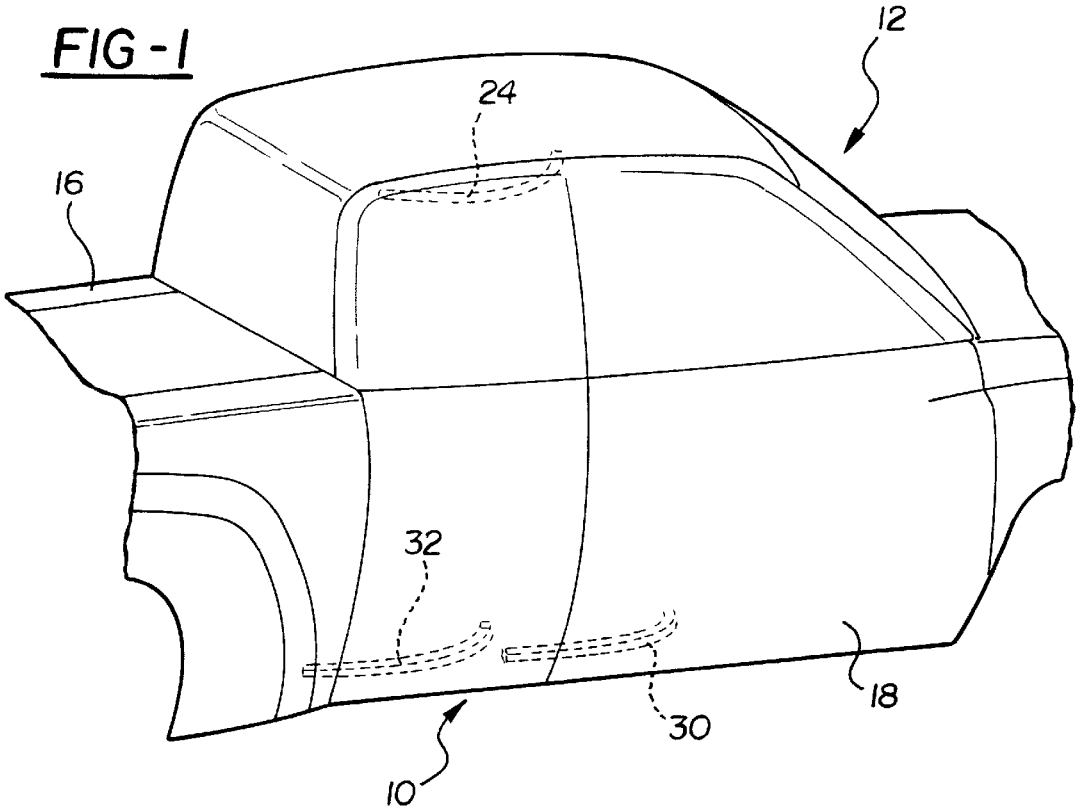
FIG. 1 is a partial perspective view of a pick-up truck with an extended cab having a sliding rear door.
Figure 2:
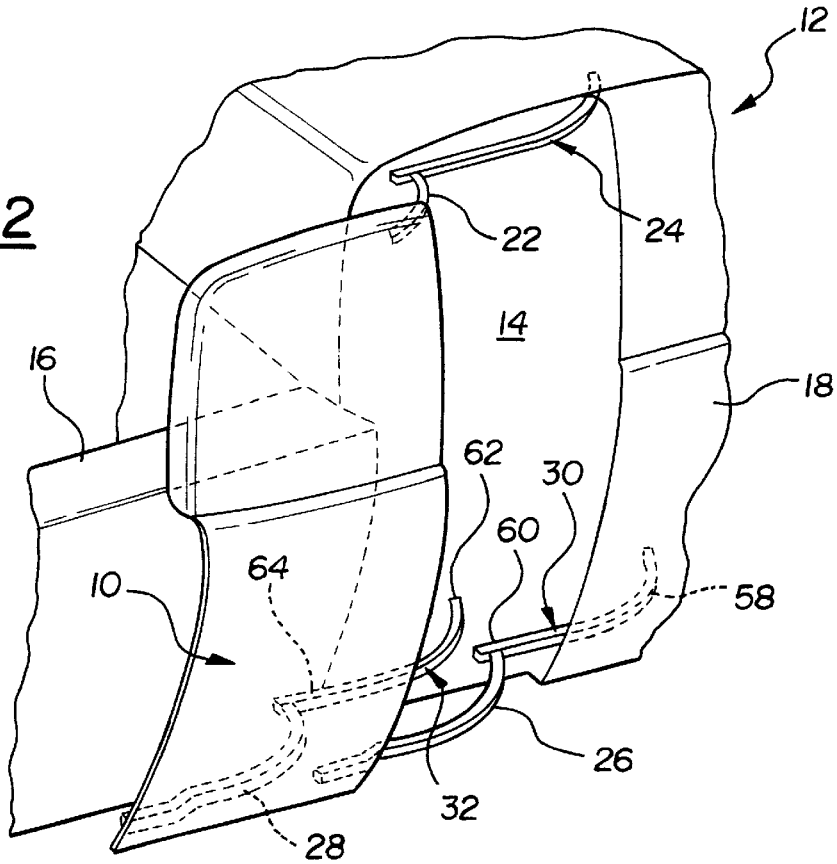
FIG. 2 is a partial perspective view similar to FIG. 1 with the sliding rear door shown in an open position.
Figure 3:
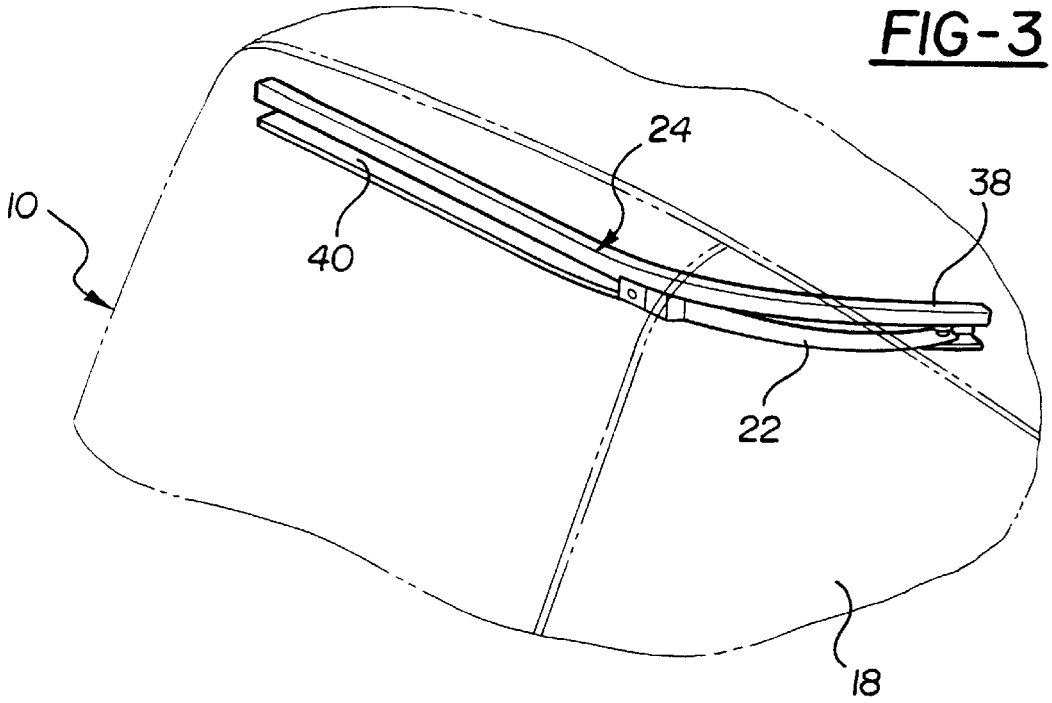
FIG. 3 is a perspective view of the upper guide track and upper guide arm assembly.
Figure 4:
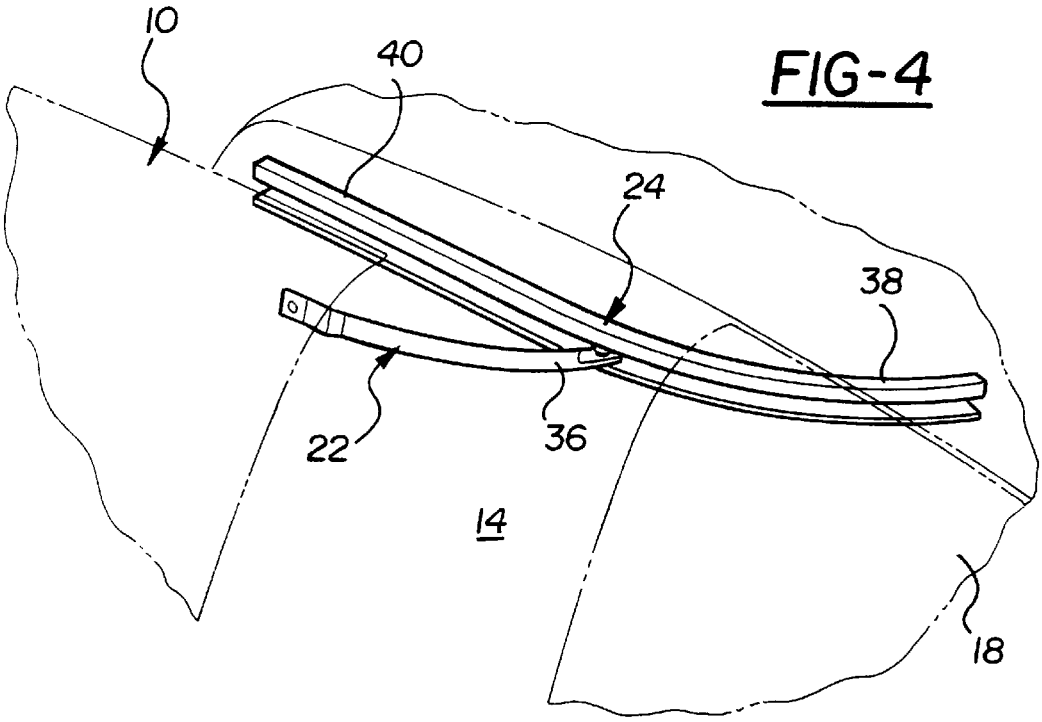
FIG. 4 is a detailed view of the upper guide track and upper guide arm with the rear sliding door in an open position.
Figure 7:
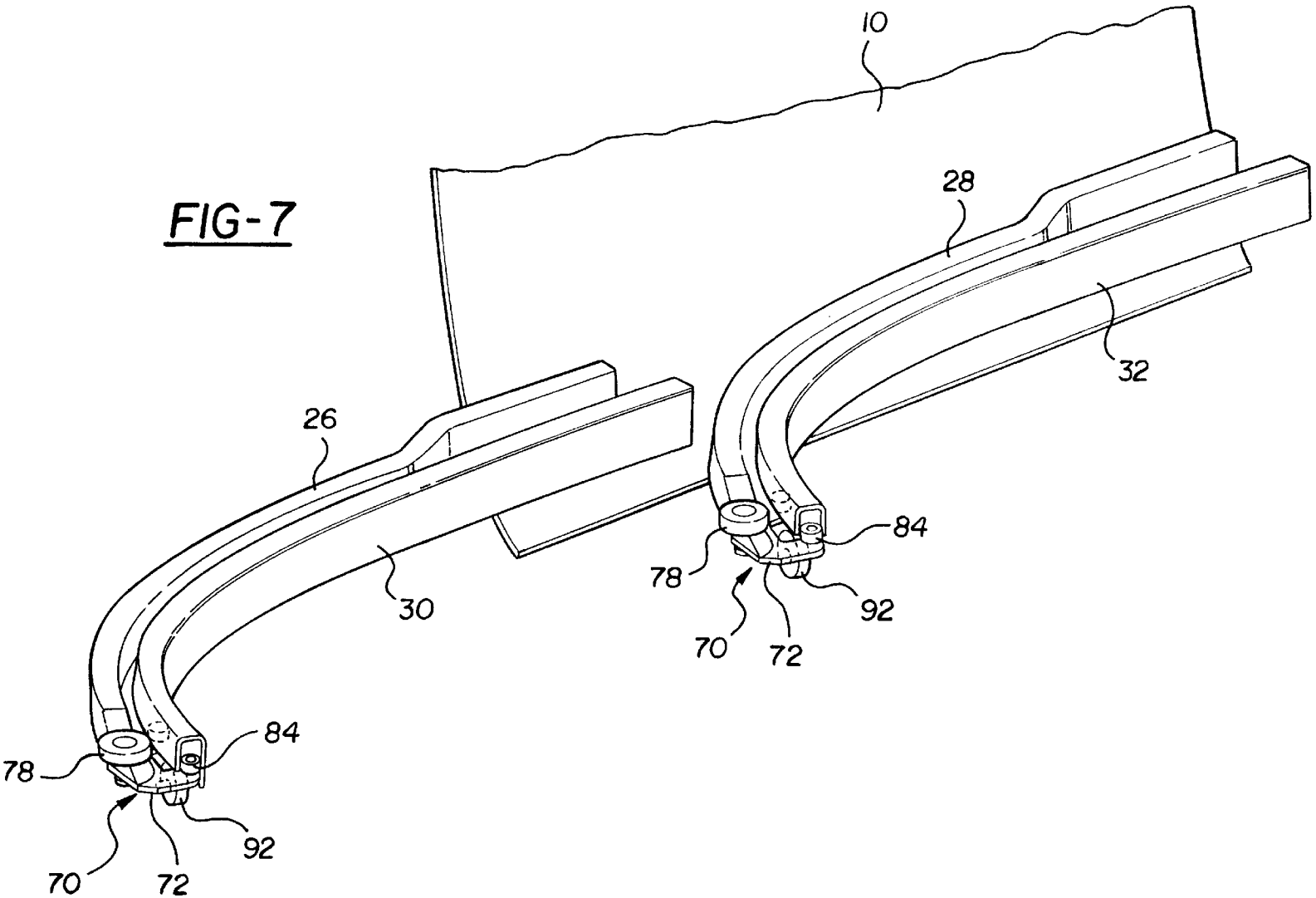
FIG. 7 is perspective view of the front and rear lower guide track and front and rear lower arm assemblies.

With reference to FIGS. 1–8, the sliding rear door 10, according to the present invention, will be described. FIGS. 1 and 2 illustrate a pick-up truck 12 having a club-cab type passenger compartment 14 and a bed portion 16 disposed rearward thereof. The club-cab passenger compartment 14 includes driver side and passenger side front doors 18. The sliding rear door 10 is disposed rearward of the front doors 18. For simplicity, only one rear sliding door 10 will be described, however, it should be understood that a sliding rear door 10 may be utilized on both the driver and passenger sides of the vehicle 12. The rear cut line of the sliding rear door 10 can be on the rear or the side of the passenger compartment 14.

According to a preferred embodiment of the present invention, a B-pillar is disposed between the front door 18 and the sliding rear door 10. The front door 18 and sliding rear door 10 are each provided with a conventional latch mechanism for latching their respective doors in the closed position. If no B-pillar is desired, the front door 18 and sliding rear door 10 can latch to one another or to a latch member mounted to the door sill or above the door opening.

The sliding rear door 10 is provided with a three-point support system which includes an upper guide arm 22 which engages an upper guide track 24 and a pair of lower guide arms 26, 28 which engage a pair of lower guide tracks 30, 32. The three point support system is utilized for stabilizing the door 10.

The upper guide arm 22 is mounted to an upper front comer of the sliding rear door 10, either by fasteners or by welding. The upper guide arm 22 extends generally forward and laterally inward from the door 10. A guide roller 34 is mounted on an end 36 of the upper guide arm 22, as best seen in FIG. 5. The upper guide track 24 is generally J-shaped with an inwardly curved forward portion 38 terminating forward of the leading edge of the door opening. A generally straight rearward portion 40 of upper guide track 24 generally terminates forward of a rear edge of the door opening. The upper guide arm 22 is also generally J-shaped and piggy backs against the upper guide track in a closed position.

As shown in FIG. 5, the upper guide track 24 is disposed between the roof panel 42 of the passenger compartment 14 and the ceiling trim member 44. A support member 46 is provided for supporting the upper guide track 24. An open slot 48 is provided between the roof panel 42 and ceiling trim member 44 for receiving the upper guide arm 22 for engagement with the upper guide track 24. A seal member 50 is provided along the roof panel 42 and along a lower portion of support member 46 and engages the door frame 52 which surrounds the window 54 in sliding rear door 10.

The sliding rear door 10 is additionally supported at two lower points by a lower front guide arm 26 which engages a lower front guide track 30 and a lower rear guide arm 28 which engages a lower rear guide track 32. Each of the lower guide tracks 30, 32 are generally J-shaped with the lower front track 30 having an inwardly curved forward portion 58 disposed forward of the leading edge of the door opening and a generally straight rearward portion 60. Similarly, the lower rear track 32 includes an inwardly curved forward portion 62 disposed generally in the area of the leading edge of the door opening and a generally straight rearward track portion 64 terminating approximately at a rear edge of the door opening. The front and rear lower guide arms 26, 28 are also generally J-shaped and piggy back against the front and rear guide tracks 30, 32 in a closed position. The lower front guide arm 26 is mounted to a lower front corner of the interior of the sliding rear door 10 and the lower rear guide arm 28 is mounted to a lower rear corner of the interior of the sliding rear door 10. Each of the lower guide arms 26, 28 extend generally longitudinally forward from their mounting locations and are curved laterally inwardly with approximately the same radius of curvature of front portions 58, 62 of the lower front and rear guide tracks 30, 32 respectively. The shape and position of the guide tracks 24, 30, and 32 as well as the guide arms 22, 26, and 28 determine the range of motion of the door 10. Shorter guide tracks dictate a shorter range of motion for the door 10 while longer guide tracks dictate a longer range of motion. Furthermore, the length of the guide tracks are dictated by the door size.

Figure 8:
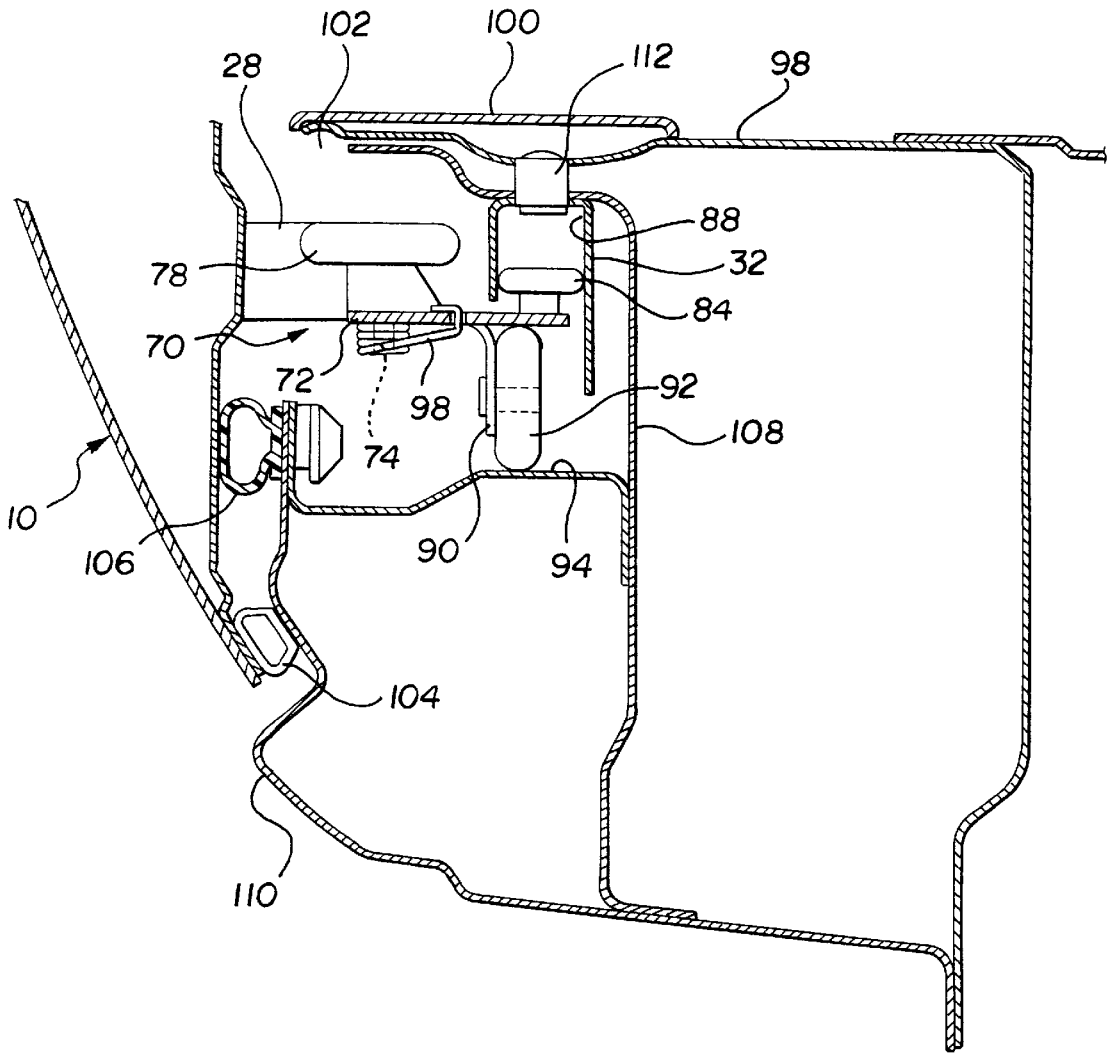
FIG. 8 is a cross-sectional view of a lower guide track and guide arm assembly with the door in a closed position.

With reference to FIG. 6, each of the lower guide arms 26, 28 support a guide and support roller assembly 70 on an end thereof. Each guide and support roller assembly 70 includes a pivot bracket 72 pivotally mounted to the guide arms 26, 28. The pivot bracket 72 is mounted to the guide arms 26, 28 by a fastener 74 and nut 76 assembly. A cup-shaped washer member 78 is provided with rounded edges which allow the head of the fastener 74 to be recessed therein so that there are no exposed sharp edges. The pivot bracket 72 includes a pair of finger portions 80, 82 which each support a guide roller 84 via a fastener for engagement with a guide channel portion 88 of the front and rear lower guide tracks 30, 32. The pivot bracket 72 also includes a downwardly extending third finger portion 90, best shown in FIG. 8, which supports a support roller 92 which rides along a roller support surface 94 disposed below the front and rear lower guide tracks 30, 32 as shown in FIG. 8. A torsion spring 98 is provided on the fastener 74 and engages the guide arm 28 and pivot bracket 72 in order to bias the pivot bracket 72 in a predetermined direction in order to prevent rattle of the guide rollers 84 within the guide channel 88.

The front and lower guide tracks 30, 32 are disposed generally below the floor panel 99 of the passenger compartment, and more particularly, extend at least partially under the door sill plate 100. An opening 102 is provided between the door sill plate 100 and the roller support surface 94 for receiving the lower guide arms 26, 28 for engagement with the lower guide tracks 30, 32. A first seal member 104 is provided along a lower surface of the sliding rear door 10 and a second seal member 106 is provided just below the opening 102 for providing a sealed closure when the sliding rear door 10 is in a closed position. The roller support surface 94 is mounted between a support frame member 108 and a lower body panel member 110. The front and rear lower guide tracks 30, 32 are also supported by the support frame member 108 such as by a fastener 112, welding or other fastening means.

In operation, as the door latch for the sliding rear door 10 is released, and the door 10 is pulled in a rearward direction, the guide rollers 34, 84 on the upper and lower guide arms 22, 26, and 28, respectively, follow the upper and lower guide tracks 24, 30, and 32 so as to move the sliding rear door 10 in a laterally outward direction along the curved front portions 38, 58 and 62 of each of the guide tracks 24, 30, and 32, respectively. The curved front portions 38, 58, and 62 of the guide tracks 24, 30, and 32 are designed to guide the sliding rear door 10 laterally outward far enough so as to clear the body side panels of the truck bed 16 so that the sliding rear door 10 can be moved rearward along the generally straight rearward portions of the guide tracks 24, 30, and 32. Preferably, as the sliding rear door 10 is moved to its aft-most position, the sliding rear door 10 is completely clear of the door opening so that optimal access to the rear passenger/cargo compartment can be obtained.

When the sliding rear door 10 is in the closed position, the guide tracks 24, 30, and 32 are completely concealed from view. Specifically, the upper guide track 24 is concealed by the ceiling trim member 44 or ceiling headliner, roof panel 42, and door frame 52 of the rear sliding door 10. Furthermore, the lower guide tracks 30, 32 are concealed by the floor panel 99 and the lower portion of the sliding rear door 10. When the sliding rear door 10 is in its fully open position, the guide arms 22, 26, 28 each extend in a forward direction in engagement with the rearward portions of their corresponding guide tracks 24, 30, 32, respectively.

With the design of the present invention, improved ingress/egress over a conventional hinged door can be obtained. Furthermore, with the three-point suspension system with all tracks ending forward of the rear edge of the sliding door, the sliding rear door assembly of the present invention is capable of sufficiently supporting the sliding rear door without requiring a guide track to extend along the truck bed 16 of the vehicle. Furthermore, the sliding door assembly of the present invention does not have any exposed tracks or slots with the door in the closed position.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A pickup truck, comprising:

an extended cab passenger compartment;

a pair of front doors disposed on opposite sides of said passenger compartment;

a sliding, rear door disposed rearward of one of said pair of front doors, said sliding rear door being supported for sliding movement between a closed position and an open position by an upper track and a pair of lower tracks, said upper track and said pair of lower tracks each being engaged by a respective guide arm which is mounted to the sliding rear door, the upper track being mounted below a roof panel and said pair of lower tracks being mounted below a floor of the extended cab passenger compartment, said pair of lower tracks being mounted to said extended cab passenger compartment such that a rear edge of each of said pair of lower tracks is forward of a rear edge of an opening in said passenger compartment for said sliding rear door.

2. The pickup truck according to claim 1, further comprising a roller disposed on an end of said guide arm engaged with said upper track.

3. The pickup truck according to claim 1, further comprising a pivot bracket disposed on an end of at least one of said guide arms engage with said lower tracks, said pivot bracket supporting a first support roller for generally vertically supporting said at least one of said guide arms engage with said lower tracks along a roller support surface.

4. The pickup truck according to claim 3, wherein said pivot bracket further supports a pair of guide rollers for engagement with one of said lower tracks.

5. The pickup truck according to claim 1, wherein said upper and lower tracks and said guide arms are generally J-shaped.

6. The pickup truck according to claim 1, wherein said pair of lower tracks comprise a forward lower track and a rear lower track, said rear lower track being mounted to the extended cab passenger compartment such that said rear edge of said rear lower track is forward of said rear edge of said opening for said sliding rear door.

7. The pickup truck according to claim 1, wherein each of said guide arms extends generally forward, in a longitudinal direction of said pickup truck, from a respective mounting location on said sliding rear door.

* * * * *